United States Patent [19]
Sistrunk
[11] 4,167,603
[45] Sep. 11, 1979

[54] FLAME RESISTANT COTTON/POLYESTER BLEND SUBSTRATES

[75] Inventor: Thomas O. Sistrunk, Southfield, Mich.

[73] Assignee: Ethyl Corporation, Richmond, Va.

[21] Appl. No.: 939,283

[22] Filed: Sep. 5, 1978

Related U.S. Application Data

[63] Continuation of Ser. No. 750,231, Dec. 13, 1976, which is a continuation-in-part of Ser. No. 571,738, Apr. 25, 1975, Pat. No. 3,997,699.

[51] Int. Cl.[2] ..... D06M 13/10; D06M 13/44

[52] U.S. Cl. ..... 428/260; 8/115.7; 8/116 P; 8/181; 252/8.1; 427/394; 427/402; 428/272; 428/276; 428/277; 428/921

[58] Field of Search ..... 8/115.7, 116 P, 181; 260/611 A, 932, 961, 45.7 P, 551 P; 427/372, 394, 402; 428/276, 277, 480, 532, 921, 260; 252/8.1

[56] References Cited

U.S. PATENT DOCUMENTS

| | | | |
|---|---|---|---|
| 2,642,413 | 6/1953 | Coover | 260/77.5 |
| 3,325,569 | 6/1967 | D'Alelio | 260/932 |
| 3,478,095 | 11/1969 | Normant | 260/551 |
| 3,712,789 | 1/1973 | Linderman et al. | 8/116 P |
| 3,816,068 | 6/1974 | Rivlin | 8/115.7 |
| 3,877,952 | 4/1975 | Dahmen et al. | 106/15 FP |
| 3,877,974 | 4/1975 | Mischutin | 428/290 |
| 3,922,459 | 11/1975 | Franz et al. | 428/297 |
| 4,036,809 | 7/1977 | Kelbys | 260/45.7 P |

FOREIGN PATENT DOCUMENTS

| | | | |
|---|---|---|---|
| 775146 | 1/1968 | Canada | 260/551 P |
| 1113811 | 9/1961 | Fed. Rep. of Germany | |

OTHER PUBLICATIONS

Tesoro, "Status and Prospects for Flame Resistant Polyester/Cellulose Blend Fabrics," Mar. 1973, National Bureau of Standards Report COM-73-11265.

*Primary Examiner*—P. E. Willis, Jr.
*Attorney, Agent, or Firm*—Donald L. Johnson; John F. Sieberth; James M. Pelton

[57] ABSTRACT

A flame resistant substrate composed of cotton and flame retardant polyester fibers having a flame retardant affixed thereto and a method for increasing the flame resistance of a substrate composed of cotton and polyester fibers.

34 Claims, No Drawings

FLAME RESISTANT COTTON/POLYESTER BLEND SUBSTRATES

CROSS-REFERENCE TO RELATED APPLICATION

This is a continuation of application Ser. No. 750,231, filed Dec. 13, 1976, which in turn is a Continuation-in-Part of application Ser. No. 571,738, filed Apr. 25, 1975, now U.S. Pat. No. 3,997,699.

BACKGROUND OF THE INVENTION

Fabrics comprising blends of cotton with polyester fibers are of considerable commercial importance because of their widespread use in apparel. However, such fabrics are highly flammable. To reduce the flammability of such blends, a flame retardant must be applied to the fabric. A flame retardant is a substance which increases the resistance of a substrate to burning or charring. Flame retardants are known for 100 percent cotton fabrics, but researchers in this field have concluded that the flammability of blend fabrics cannot be predicted from knowledge of the flammability of fabrics made from a single fiber, G. C. Tesoro, Status and Prospects for Flame Resistant Polyester/Cellulose Blend Fabrics, National Bureau of Standards Report COM-73-11265, March, 1973. One important reason for this unpredictability of blend fabrics, e.g., cotton/polyester blends, is the so-called "grid" or "scaffold" effect by which one component of the blend forms a supporting matrix for continued burning of the other component. With regard to this effect, W. Kruse reported:

> "In all textile mixtures containing a component capable of forming a structural network (e.g. polyester) account must be taken of the scaffold effect, as it substantially alters the combustion behavior of thermoplastic synthetic fibers.
>
> "In mixed textiles the framework is built in all cases by organic material. Interestingly enough, it is also possible to arrive at a scaffold effect with inorganic material if, for instance, single component fabrics of thermoplastic fibers are given a framework forming finish (e.g. silicate)." W. Kruse, Melliand Textilber, April 1969, pp. 460–469 (Gottlieb Duttweiler Institute Publication No. 45, pp. 137–161, 1969), Combustibility and Flame Resistant Finishing of Mixed Textiles.

In accordance with existing technology, polyester fibers can be flame retarded. In one method, a brominated component, tetrabromobisphenol-A ethoxylate, is incorporated in the polymerization reaction producing the polyester from which the fiber is spun. In another method, a polyester fiber is treated topically with an aqueous dispersion of tris-(2,3-dibromopropyl)phosphate which, at elevated temperature, undergoes a thermally induced diffusion into the polyester fiber, thereby reducing the flammability of the fiber.

Polyester fibers having tetrabromobisphenol-A ethoxylate incorporated therein or treated with tris-(2,3-dibromopropyl)phosphate are themselves flame retardant, but when blended with cotton the fire retardance of the polyester is insufficient to render the blend flame retardant. In my co-pending application Ser. No. 571,738, now U.S. Pat. No. 3,997,699 there was disclosed a method of flame retarding cotton/polyester blend fabrics in which the polyester component was flame retarded with tetrabromobisphenol-A ethoxylate and then the blend fabric was treated with an aqueous solution of an organo phosphonic diamide, dried and cured to provide a material of significantly improved flame resistance. However, it is expensive and inconvenient to flame retard one component of a cotton/polyester blend before the blend fabric is produced. It would be more desirable to add both bromine and phosphorus in suitable form to the blend fabric as produced. This is the object of the present invention.

The Invention

According to the present invention there is provided a flame retardant substrate comprising a blend of cotton and polyester fibers, said substrate having affixed thereto a flame retardant amount of a bromine-containing compound selected from (a) a compound having the formula

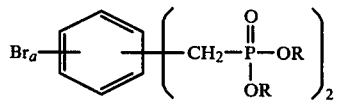

in which R is alike or different and is selected from lower hydrocarbyl-groups and a is an integer from 2–4, and (b) a compound having the formula

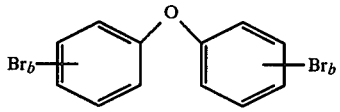

in which b is an integer from 2–5; and a phosphorus-containing compound of the formula

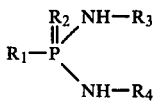

in which $R_1$ is methyl, ethyl, propyl, phenyl, $ClCH_2$ or $BrCH_2$; $R_2$ is oxygen or sulfur, $R_3$ is hydrogen, methyl, ethyl or propyl, and $R_4$ is hydrogen, methyl, ethyl or propyl.

In another aspect of the invention there is provided a flame resistant substrate comprising a blend of cotton and polyester fibers containing about 35 to about 75 weight percent polyester, said substrate having affixed thereto a flame retardant amount of a bromine-containing compound selected from (a) a compound having the formula

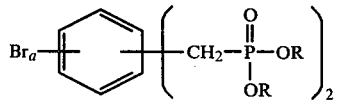

in which R is alike or different and selected from lower hydrocarbyl-groups and a is an integer from 2–4, and (b) a compound having the formula

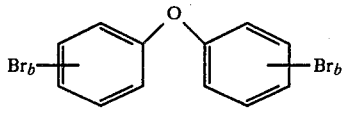

in which b is an integer from 2–5, and a phosphorus-containing flame retardant compound having the formula

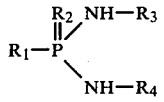

in which $R_1$ is methyl, ethyl, propyl, phenyl, $ClCH_2$ or $BrCH_2$; $R_2$ is oxygen or sulfur; $R_3$ is hydrogen, methyl, ethyl or propyl; and $R_4$ is hydrogen, methyl, ethyl or propyl, the amount of said bromine- and said phosphorus-containing compounds being sufficient to impart from 1.5 to about 4 weight percent of bromine and from 1.5 to about 2.5 weight percent of phosphorus to said substrate.

A further aspect of the invention provides a method for increasing the flame resistance of a substrate composed of a blend of cotton and polyester fibers comprising treating said substrate with an aqueous solution or suspension of a bromine-containing compound selected from (a) a compound having the formula

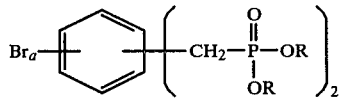

in which R is alike or different and selected from lower hydrocarbyl-groups and a is an integer from 2–4, and (b) a compound having the formula

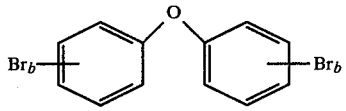

in which b is an integer from 2–5, and a phosphorus-containing compound of the formula

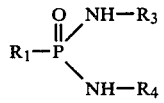

in which $R_1$ is methyl, ethyl, propyl, phenyl, $ClCH_2$ or $BrCH_2$; $R_2$ is oxygen or sulfur; $R_3$ is hydrogen, methyl, ethyl or propyl; and $R_4$ is hydrogen, methyl, ethyl or propyl; and $R_4$ is hydrogen, methyl, ethyl or propyl, drying the substrate and curing the substrate.

An additional aspect of the invention provides a method for increasing the flame resistance of a substrate composed of a blend of cotton and polyester fibers comprising (A) applying to the surface of said substrate a bromine-containing compound selected from (i) a compound having the formula

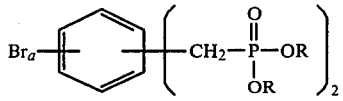

in which R is alike or different and selected from lower hydrocarbyl-groups and a is an integer from 2–4, and (ii) a compound having the formula

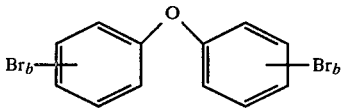

in which b is an integer from 2–5;

(B) heating the substrate to a temperature in the range of about 160 to about 220° C. for a time sufficient to diffuse into the fiber structure a quantity of said bromine-containing compound to result in, based on the weight of said substrate, 1.5 to about 4 weight percent bromine, (C) treating said substrate containing said bromine-containing compound with an aqueous solution or suspension of a phosphorus-containing compound of the formula

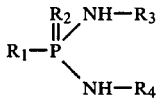

in which $R_1$ is methyl, ethyl, propyl, phenyl, $ClCH_2$ or $BrCH_2$; $R_2$ is oxygen or sulfur; $R_3$ is hydrogen, methyl, ethyl or propyl; and $R_4$ is hydrogen, methyl, ethyl or propyl, (D) drying the substrate, and (E) curing the substrate by heating for an additional time and at a temperature sufficient to fix said phosphorus-containing compound to said substrate.

The substrates useful in this invention are blends of cotton and polyester fibers conventionally known to those skilled in the textile art. Such blend fabric may contain from 15% to about 85% polyester by weight, the remainder being cotton. Preferably, the fabric may contain from about 35% to about 75% polyester by weight. More preferably, the fabric may contain from about 45% to about 65% polyester by weight. A most especially preferred polyester/cotton blend is a 50/50 weight percent blend.

The phosphorus-containing flame retardants used in the present invention are those compounds having the general formula

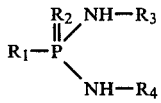

where $R_1$ methyl, ethyl, propyl, phenyl, $ClCH_2$ or $BrCH_2$; $R_2$ is oxygen or sulphur; $R_3$ is hydrogen, methyl ethyl or propyl, and $R_4$ is hydrogen, methyl, ethyl or propyl. Preferred flame retardants are those where $R_1$ is an ethyl or methyl group, and $R_3$ and $R_4$ are hydrogen atoms. The most preferred is a compound in which $R_1$ is a methyl group, $R_2$ is oxygen, and $R_3$ and $R_4$ are hydrogen atoms, i.e., methyl phosphonic diamide, hereinafter abbreviated as MPDA. MPDA can be prepared according to the method of Ratz, *J. Am. Chem. Soc.*, 77 4170 (1955), which is hereby incorporated by reference as if fully set forth. Certain halomethyl phosphonic acid bisamides have previously been disclosed as flame retardants in Dutch Patent Publication 66/5,460. In addition, flame retardants containing the

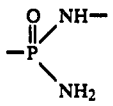

group have been disclosed in U.S. Pat. No. 2,648,597, which is hereby incorporated by reference.

Preferably the phosphorus-containing flame retardant is 100% pure, but various other compounds such as salts may be intermixed with the phosphorus-containing flame retardants when produced commercially. Preferably, such compounds are water soluble so that they can be easily removed from the substrate by washing. For example, salts such as ammonium chloride, sodium chloride, and the like, may be intermixed with the flame retardant. Such compounds are by-products of one process by which the phosphorus-containing flame retardant can be made, and because of the difficulty in separating them from the flame retardant, it is convenient to have them intermixed therewith. They are permissible and do not detract from the advantages of the present invention. Such other compounds may be intermixed with the flame retardant in amounts of up to about 150% of the flame retardant by weight, more preferably, in amounts of up to about 120% of the phosphorus-containing flame retardant by weight.

The bromine-containing flame retardant compound used in the present invention is selected from polybrominated aromatic compounds of either general formula given hereinabove. As can be seen, one of the general formulas for the bromine-containing compound also contains a small amount of phosphorus. However, the percentage of bromine in such compound is much greater than that of phosphorus.

In one preferred embodiment of this invention, the bromine-containing compound is a polybrominated biphenyl oxide of which the tetra-, hexa-, octa- and decabromobiphenyl oxide may be mentioned. More preferable is decabromobiphenyl oxide because of its greater bromine content. Such polybrominated biphenyl oxides may be prepared according to known procedures.

In another preferred aspect of this invention the bromine-containing flame retardant can be made by reacting a phosphite with an $\alpha,\alpha'$-dihaloxylene. Preferably, the phosphite is one in which at least one of the radicals attached to oxygen is an aliphatic hydrocarbyl-group. Exemplary phosphites are $(BrC_6H_4O)_2POCH_3$, $(Br_3C_6H_2O)_2POCH_3$, $(Br_3C_6H_2O)\ P(OCH_3)_2$ and the like. Other exemplary radicals may be selected from those set forth in Column 3, line 15 to Column 5, line 17 of U.S. Pat. No. 2,818,416, which portion of that patent is incorporated herein by reference as if fully set forth. Of these radicals, the lower hydrocarbyl radicals are preferred. Thus, the R groups of the phosphites useful in preparing the bromine-containing compound of this invention have from 1 to about 9 carbon atoms which may be alike or different.

The $\alpha,\alpha'$-dihaloxylene with which the above phosphites are reacted can be those with from 1 to 4 bromine atoms substituted on the aromatic nucleus. Preferably, the $\alpha,\alpha'$-dihaloxylene is $\alpha,\alpha'$,2,3,5,6-hexabromo-p-xylene. Such compounds and their preparation are disclosed in U.S. Pat. No. 3,899,466 the portions of which deal with preparation of the $\alpha,\alpha'$-dibromoxylenes are incorporated by reference herein as if fully set forth.

The bromine-containing compound employed in this invention is prepared by reacting the above described phosphites and $\alpha,\alpha'$-dihaloxylene, preferably using excess phosphite in the presence of a liquid reaction medium at temperatures from 80° to about 250° C. Such procedures are more fully described in the application of K. A. Keblys, Ser. No. 618,890, filed Oct. 2, 1975 now U.S. Pat. No. 4,036,809, which is incorporated by reference herein as if fully set forth.

Highly preferred bromine-containing compounds useful in this invention are tetramethyl[(2,3,5,6-tetrabromo-p-phenylene)dimethylene]diphosphonate and similar compounds in which the tetramethyl groups are replaced by hydrocarbyl groups and halosubstituted hydrocarbyl groups of from one to about 9 carbon atoms.

The amount of the bromine-containing and the phosphorus-containing flame retardant may be varied in accordance with the degree of flame retardance desired. The amount of flame retardant is expressed as a percentage which is determined by dividing the weight of the flame retardant solid on the treated fabric by the weight of the untreated fabric and multiplying the quotient by 100. Such a percentage is hereinafter referred to as percent dry add-on (and is abbreviated percent DAO). The percent dry add-on of the bromine-containing and the phosphorus-containing flame retardant may vary from about 2% to about 35%, preferably from about 5% to about 20%, and more preferably, from about 7% to about 15%.

The solution with which the cotton/polyester substrates are treated contains from about 5% by weight to about 30% by weight of the bromine-containing and the phosphorus-containing flame retardant, the remainder being water. More preferably, the treating solution contains from about 15% by weight to about 25% by weight for a combined total of the bromine-containing and the phosphorus-containing flame retardant, the remainder being water.

The cotton/polyester substrate may be treated or impregnated with a solution of the bromine-containing and the phosphorus-containing flame retardant, by dipping the substrate into the solution of the combined bromine-containing and phosphorus-containing flame retardant or by spraying or padding the solution of such flame retardant on the substrate and allowing the substrate to dry. The solution of such flame retardant may also be applied by spraying, dipping, padding, or the like. After the solution of such flame retardant has been applied, the substrate is dried by any conventional means known in the art.

After drying, the substrate is then cured by heating at a temperature sufficiently high enough and for sufficient time to firmly bond the bromine-containing and the phosphorus-containing flame retardant to the substrate. Curing preferably is carried out at a temperature of from about 160° C. to about 185° C. for a period of from about ½ minute to about 5 minutes, or more preferably at a temperature of from about 170° C. to about 175° C. for a period of from about ½ minute to about 1½ minutes. After curing, the substrate may be washed to remove any salt such as ammonium chloride or sodium chloride which may be on the fabric. After washing the substrate is then redried as in the previous drying.

In another method, the blend fabric can be sequentially impregnated with first the bromine-containing compound, followed by treatment as described above with the phosphorus-containing compound. Preferably the bromine-containing compound is diffused into the fiber structure by heating the treated blend at a temperature of about 160° C. to about 220° C. for about 2 to about 10 minutes. The bromine-containing compound can be applied to the blend fabric as a solution in organic solvents or as emulsions or suspensions in water. Suitable solvents include the lower alcohols, ketones, esters, aromatic hydrocarbons and chlorinated hydrocarbons.

The bromine-containing and phosphorus-containing compounds employed in this invention were applied to several blend fabrics of cotton/polyester of woven construction containing 50 weight percent cotton and polyester and to fabric containing 65 weight percent polyester −35 weight percent cotton. In one test the fabric was impregnated by dipping in a solution containing both the bromine- and phosphorus-containing compounds and in another test the bromine-containing compound was first diffused into the fabric followed by solution impregnation with the phosphorus-containing compound. The conditions and results of heat release measured in calories per square centimeter per second are given in the following tables:

TABLE 1

Simultaneous Application of Bromine- and Phosphorus-containing Compound in Treating Solution

| Example No. | 1 | 2 |
|---|---|---|
| Fabric[1] Weight, g | 5.5 | 5.0 |
| Treating Solution | | |
| MPDA, g | 3.6 | 3.6 |
| DBBPO[2], g | 2.1 | |
| TTPDDP[3], g | | 3.5 |
| Binder[4], g | 1.5 | 1.5 |
| Dispersant, NaOH, Water[5] | 22.8 | 21.4 |
| Total | 30.0 | 30.0 |
| Wet Weight, g | 10.5 | 9.7 |
| Wet Pick Up, wt % | 90 | 94 |
| Post Cure[6] Weight, g | 6.7 | 6.2 |
| % DAO | 18 | 18 |
| Analysis of Treated Fabric | | |
| Br | 3.2 | 2.0 |
| P | 1.4 | 1.8 |
| Heat Release Value[7], cal./cm²/sec. | .097 | .04 |

Notes:
1. Fabric treated was 50% cotton, 50% polyester woven construction weighing 4 oz./square yard.
2. DBBPO is an abbreviation for decabromobiphenyl oxide.
3. TTPDDP is an abbreviation for tetramethyl[(2,3,5,6-tetrabromo-p-phenylene)-dimethylene]diphosphonate.
4. Binder is employed to aid in fixing the frame retardants to the fabric and is not necessary to the invention but provides greater durability in laundering. Commercially available materials such as acrylic latex binders can be employed.
5. Dispersant, NaOH, water - in these Examples a commercially available dispersant, such as TAMOL 850, ACRYSOL A-5 or AEROSOL OT, sufficient to give good suspension or emulsion was used. Also about 5 drops of 50% caustic sufficient to bring the solution to pH 7 was added to the treating solution. The remainder was water.
6. Cure conditions were 175° C. for 2 minutes.
7. Heat Release Value is the amount of heat generated by burning the treated fabric with a standard flame for 12 seconds after application of the flame at an angle of 90° to the cloth according to the NBS proposed test known as the Mushroom Apparel Flammability Test. The heat release value is measured in calories per square centimeter of fabric per second and a value of 0.1 cal./cm²/sec. or greater is considered unacceptable.

TABLE 2

Consecutive Application of Bromine-containing Compound by Diffusion Followed by Treatment With Phosphorus-containing Compound in Treating Solution

| Example No. | 3 |
|---|---|
| Fabric | Woven 50% cotton/50% polyester, 4 oz./yd.[2] |
| Diffusion Treatment | |
| Fabric Weight, g | 9.8 |
| Treating Solution | TTPDDP[1] 10.5 wt % in $CHCl_3$ |
| Wet Weight, g | 28.3 |
| Dry Weight, g | 11.9 |
| Cure Conditions | 200° C. at 2 min. |
| Post Cure Weight, g | 11.4 |
| Weight after Conditioning at ambient temperature and relative humidity, g | 11.5 |
| % DAO | 17.3 |
| Solution Treatment of Above Fabric | |
| After Diffusion Treatment | |
| Fabric Weight, g | 11.5 |
| Treating Solution | 11.7 Wt % MPDA[2]; 3 Wt % urea; pH 7 |
| Wet Weight, g | 19.9 |
| Wet Pick Up, % | 73 |
| Post Cure[3] Weight, g | 12.5 |
| Weight After Conditioning at Ambient Temperature, Relative Humidity, g | 12.8 |
| % DAO | 11.3 |
| Analysis of Fabric, % | |
| Br | 3.4 |
| P | 2.3 |
| Heat Release Value[4], cal./cm²/sec. | 0.05 |

Notes:
1. TTPDDP is an abbreviation for tetramethyl[(2,3,5,6-tetrabromo-p-phenylene)-dimethylene]diphosphonate.
2. In this Example, the MPDA was of a purity of 97.5% and had 2.5% by weight of diethyl amine hydrochloride which had not been removed from the MPDA as produced.
3. Cure conditions were 170° C. for 2.5 minutes.
4. See Table 1, note 7.

What is claimed is:

1. A flame retardant substrate comprising a blend of cotton and polyester fibers, said substrate having affixed thereto a flame retardant amount of a bromine-containing compound selected from tetramethyl[(2,3,5,6-tetrabromo-p-phenylene)-dimethylene]diphosphite and decabromobiphenyl oxide; and a phosphorus-containing compound of the formula

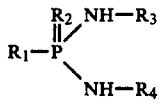

in which $R_1$ is methyl, ethyl, propyl or phenyl; $R_2$ is oxygen or sulfur; $R_3$ is hydrogen, methyl, ethyl or propyl; and $R_4$ is hydrogen, methyl, ethyl or propyl.

2. The substrate of claim 1 wherein said substrate contains from about 15% to about 85% by weight polyester, the remainder being cotton.

3. The substrate of claim 1 wherein said substrate contains about 35% to about 75% polyester by weight, the remainder being cotton.

4. The substrate of claim 1 wherein said substrate contains from about 45% to about 65% polyester by weight, the remainder being cotton.

5. The substrate of claim 1 wherein said $R_1$ is an ethyl or methyl group and $R_3$ and $R_4$ are hydrogen atoms.

6. The substrate of claim 1 wherein said $R_1$ is a methyl group, said $R_2$ is oxygen and said $R_3$ and $R_4$ are hydrogen atoms.

7. The substrate of claim 1 wherein said bromine-containing compound is tetramethyl[(2,3,5,6-tetrabromo-p-phenylene)dimethylene]-diphosphite.

8. The substrate of claim 1 wherein said bromine-containing compound is decabromobiphenyl oxide.

9. The substrate of claim 1 wherein the total amount of said bromine-containing compound and said phosphorus-containing compound, measured as percent dry add-on, is from about 2% to about 35%.

10. The substrate of claim 7 wherein a water soluble compound selected from ammonium chloride and sodium chloride is intermixed with said phosphorus-containing compound.

11. The substrate of claim 10 wherein said water soluble compound is ammonium chloride.

12. The substrate of claim 11 wherein said ammonium chloride is present in an amount of up to about 150% of said phosphorus-containing compound, by weight.

13. The substrate of claim 1 wherein the total amount of said bromine-containing compound and said phosphorus-containing compound, measured as percent dry add-on, is from about 5% to about 20%.

14. The substrate of claim 1 wherein the amount of said phosphorus-containing flame retardant compound, measured as percent dry add-on, is from about 7% to about 18%.

15. A flame resistant substrate comprising a blend of cotton and polyester fibers containing about 35 to about 75 weight percent polyester, said substrate having affixed thereto a flame retardant amount of a bromine-containing compound selected from tetramethyl[(2,3,5,6-tetrabromo-p-phenylene)-dimethylene]-diphosphite and decabromobiphenyl oxide; and a phosphorous-containing flame retardant compound having the formula

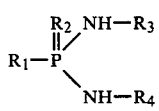

in which $R_1$ is methyl, ethyl, propyl or phenyl; $R_2$ is oxygen or sulfur; $R_3$ is hydrogen, methyl, ethyl or propyl; and $R_4$ is hydrogen, methyl, ethyl or propyl, the amount of said bromine- and said phosphorus-containing compounds being sufficient to impart from 1.5 to about 4 weight percent of bromine and from 1.5 to about 2.5 weight percent of phosphorus to said substrate.

16. The substrate of claim 15 wherein said $R_1$ is an ethyl or methyl group and said $R_3$ and $R_4$ are hydrogen atoms.

17. The substrate of claim 15 wherein said $R_1$ is a methyl group, said $R_2$ is oxygen and said $R_3$ and $R_4$ are hydrogen atoms.

18. A method for increasing the flame resistance of a substrate composed of a blend of cotton and polyester fibers comprising treating said substrate with an aqueous solution or suspension of a bromine-containing compound selected from tetramethyl[(2,3,5,6-tetrabromo-p-phenylene)-dimethylene]-diphosphite and decabromobiphenyl oxide; and a phosphorus-containing compound of the formula

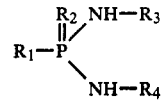

in which $R_1$ is methyl, ethyl, propyl or phenyl; $R_2$ is oxygen or sulfur; $R_3$ is hydrogen, methyl, ethyl or propyl; and $R_4$ is hydrogen, methyl, ethyl or propyl; drying the substrate and curing the substrate.

19. The method of claim 18 wherein said substrate is washed after curing to remove water soluble compounds selected from ammonium chloride and sodium chloride therefrom.

20. The method of claim 18 wherein said treating comprises coating said substrate with a solution comprising from about 5 to about 30 weight percent of said bromine-containing and said phosphorus-containing compounds.

21. The method of claim 18 wherein said curing comprises heating said substrate to a temperature of from about 165° C. to about 185° C. for a period of from about ½ minute to about 5 minutes.

22. The method of claim 18 wherein said substrate contains from about 15% to about 85% by weight polyester, the remainder being cotton.

23. The method of claim 18 wherein said $R_1$ is an ethyl or methyl group and $R_3$ and $R_4$ are hydrogen atoms.

24. The method of claim 18 wherein said $R_1$ is a methyl group, said $R_2$ is oxygen and said $R_3$ and $R_4$ are hydrogen atoms.

25. The method of claim 18 wherein said bromine-containing compound is tetramethyl[(2,3,5,6-tetrabromo-p-phenylene)-dimethylene]diphosphite.

26. The method of claim 18 in which said bromine-containing compound is decabromobiphenyl oxide.

27. The method of claim 18 in which said bromine-containing compound is tetramethyl[(2,3,5,6-tetrabromo-p-phenylene)-dimethylene]diphosphite and said phosphorus-containing compound is a compound of the formula

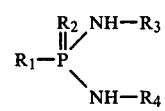

in which $R_1$ is methyl, $R_2$ is oxygen, $R_3$ and $R_4$ are both hydrogen.

28. A method for increasing the flame resistance of a substrate composed of a blend of cotton and polyester fibers comprising (A) applying to the surface of said substrate a bromine-containing compound selected from tetramethyl[(2,3,5,6-tetrabromo-p-phenylene)-dimethylene]diphosphite and decabromobiphenyl oxide;

(B) heating the substrate to a temperature in the range of about 160° to about 220° C. for a time sufficient to diffuse into the fiber structure a quantity of said bromine-containing compound to result in, based on the weight of said substrate, 1.5 to about 4 weight percent bromine;

(C) treating said substrate containing said bromine-containing compound with an aqueous solution or suspension of a phosphorus-containing compound of the formula

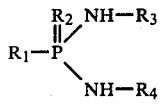

in which $R_1$ is methyl, ethyl, propyl or phenyl; $R_2$ is oxygen or sulfur; $R_3$ is hydrogen, methyl, ethyl or propyl; and $R_4$ is hydrogen, methyl, ethyl or propyl;

(D) drying the substrate; and (E) curing the substrate by heating for an additional time and at a temperature sufficient to fix said phosphorus-containing compound to said substrate.

29. The method of claim 28 in which said phosphorus-containing flame retardant compound is further defined by said $R_1$ being ethyl or methyl and said $R_3$ and $R_4$ being hydrogen.

30. The method of claim 28 in which said phosphorus-containing flame retardant compound is further defined as having said $R_1$ being a methyl group, said $R_2$ being oxygen and said $R_3$ and $R_4$ being hydrogen atoms.

31. The method of claim 28 wherein said bromine-containing compound is tetramethyl[(2,3,5,6-tetrabromo-p-phenylene)-dimethylene]diphosphite.

32. The method of claim 28 wherein said bromine-containing compound is decabromobiphenyl oxide.

33. The method of claim 28 wherein said bromine-containing compound is tetramethyl[(2,3,5,6-tetrabromo-p-phenylene)-dimethylene]diphosphite and said phosphorus-containing compound is a compound of the formula

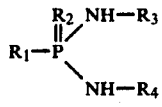

in which $R_1$ is methyl, $R_2$ is oxygen, $R_3$ and $R_4$ are both hydrogen.

34. The method of claim 28 wherein the curing temperature is from about 165° C. to about 185° C. and the curing time is from about ½ minute to about 5 minutes.

* * * * *